US008585282B2

(12) United States Patent
Shindo

(10) Patent No.: US 8,585,282 B2
(45) Date of Patent: Nov. 19, 2013

(54) SHOCK ABSORBING MEMBER FOR WRISTWATCH AND WRISTWATCH

(75) Inventor: Takayuki Shindo, Kodaira (JP)

(73) Assignee: Casio Computer Co., Ltd, Tokyo (JP)

( * ) Notice: Subject to any disclaimer, the term of this patent is extended or adjusted under 35 U.S.C. 154(b) by 225 days.

(21) Appl. No.: 13/021,896

(22) Filed: Feb. 7, 2011

(65) Prior Publication Data

US 2011/0235475 A1 Sep. 29, 2011

(30) Foreign Application Priority Data

Mar. 23, 2010 (JP) ..... 2010-065938

(51) Int. Cl.
*A44C 5/00* (2006.01)

(52) U.S. Cl.
USPC ..... 368/281; 368/286; 368/287

(58) Field of Classification Search
None
See application file for complete search history.

(56) References Cited

U.S. PATENT DOCUMENTS

| | | | | | |
|---|---|---|---|---|---|
| 2,182,830 | A | * | 12/1939 | Vedder | 368/281 |
| 2,236,650 | A | * | 4/1941 | Pujol | 368/283 |
| D310,049 | S | * | 8/1990 | Hartman et al. | D10/132 |
| D311,706 | S | * | 10/1990 | Zaugg et al. | D10/128 |
| 5,442,602 | A | * | 8/1995 | Hirai et al. | 368/286 |
| D377,761 | S | * | 2/1997 | Cross | D10/1 |
| 5,638,342 | A | * | 6/1997 | Kartsotis et al. | 368/282 |
| D449,555 | S | * | 10/2001 | Matsuda et al. | D10/132 |
| D461,737 | S | * | 8/2002 | Fong Pui Ching | D10/129 |
| 7,431,495 | B2 | * | 10/2008 | Cretin et al. | 368/287 |

FOREIGN PATENT DOCUMENTS

| | | |
|---|---|---|
| CN | 11044344 | 6/1995 |
| JP | 63-44784 | 11/1988 |
| JP | 06-006564 | 1/1994 |

OTHER PUBLICATIONS

Japanese Office Action for Japanese Application No. 2010-065938 mailed on Jan. 13, 2012.
Chinese Office Action for Chinese Application No. 2011100732203 mailed on Jul. 4, 2012.

* cited by examiner

*Primary Examiner* — Vit W Miska
(74) *Attorney, Agent, or Firm* — Turocy & Watson, LLP

(57) ABSTRACT

A shock absorbing member for a wristwatch including a wristwatch case whose side portions are provided with a pair of bands and an operation member positioned avoiding the pair of bands, and back surface has a case back attached thereto. This shock absorbing member is made of a flexible resin, and includes a peripheral side portion that surrounds the wristwatch case and projects further outward than a top surface of the wristwatch case, and a bottom portion to which the case back is attached. In addition, the peripheral side portion is provided with band holes into which the pair of bands are inserted and an operation hole corresponding to the operation member.

4 Claims, 12 Drawing Sheets

SHOCK ABSORBING MEMBER FOR WRISTWATCH AND WRISTWATCH

CROSS-REFERENCE TO RELATED APPLICATION

This application is based upon and claims the benefit of priority from the prior Japanese Patent Application No. 2010-065938, filed Mar. 23, 2010, the entire contents of which is incorporated herein by reference.

BACKGROUND OF THE INVENTION

1. Field of the Invention

The present invention relates to a shock absorbing member for a wristwatch and a wristwatch.

2. Description of the Related Art

Conventionally, as described in Japanese Examined Utility Model Application (Kokoku Koho) Publication No. S63-044784, a wristwatch is known that is configured such that the outer surface of its wristwatch case is covered by an elastic rubber member so as to absorb the shock of the wristwatch being dropped or the like thereby.

This type of wristwatch is configured such that the outer surface of its wristwatch case is covered by an elastic rubber member, and the elastic rubber member is attached to the wristwatch case by a protruding portion, which is externally protruding from a switch section provided on the side portion of the wristwatch case, being engaged with a hole portion provided in the elastic rubber member.

When a conventional wristwatch such as this falls from a table or the like (for example, from a height of about 2 m to 3 m) and hits the floor, the elastic rubber member covering the outer surface of the wristwatch case absorbs the shock by elastic deformation. However, when a strong shock is applied, such as when the wristwatch falls from a high place such as a building (for example, from a height of about 10 m) and hits the ground, the elastic rubber member cannot fully absorb the shock. As a result, the wristwatch case receives the shock, and the watch crystal and internal components are damaged thereby. Accordingly, there is a problem in the conventional wristwatches.

SUMMARY OF THE INVENTION

An object of the present invention is to provide a shock absorbing member for a wristwatch which is capable of reliably absorbing a strong shock of falling from a high place and the like, and a wristwatch equipped therewith.

In accordance with one aspect of the present invention, there is provided a shock absorbing member for a wristwatch including a wristwatch case having side portions provided with a pair of bands and an operation member positioned avoiding the pair of bands, and a back surface having a case back attached thereto, wherein the shock absorbing member is made of a flexible resin, and includes a peripheral side portion that surrounds the wristwatch case and projects further outward than a top surface of the wristwatch case, and a bottom portion to which the case back is attached, and the peripheral side portion is provided with band holes into which the pair of bands are inserted and an operation hole corresponding to the operation member. In accordance with another aspect of the present invention, there is provided a wristwatch comprising: a wristwatch case whose side portion is provided with an operation member; a case back attached to a back surface of the wristwatch case; a band attached to the side portion of the wristwatch case; and a shock absorbing member that is made of a flexible resin and includes a peripheral side portion surrounding the wristwatch case and projecting further outward than a top surface of the wristwatch case, and a bottom portion to which the case back is attached; wherein the peripheral side portion is provided with a band hole into which the band is inserted and an operation hole corresponding to the operation member.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 7 is an enlarged perspective view of when the wristwatch shown in FIG. 6 hits the ground or the like;

DETAILED DESCRIPTION OF THE PREFERRED EMBODIMENTS

The present invention will hereinafter be described in detail with reference to the preferred embodiments shown in the accompanying drawings.

First Embodiment

A first embodiment of a wristwatch to which the present invention has been applied will hereinafter be described with reference to FIG. 1 to FIG. 7.

Figure 1:
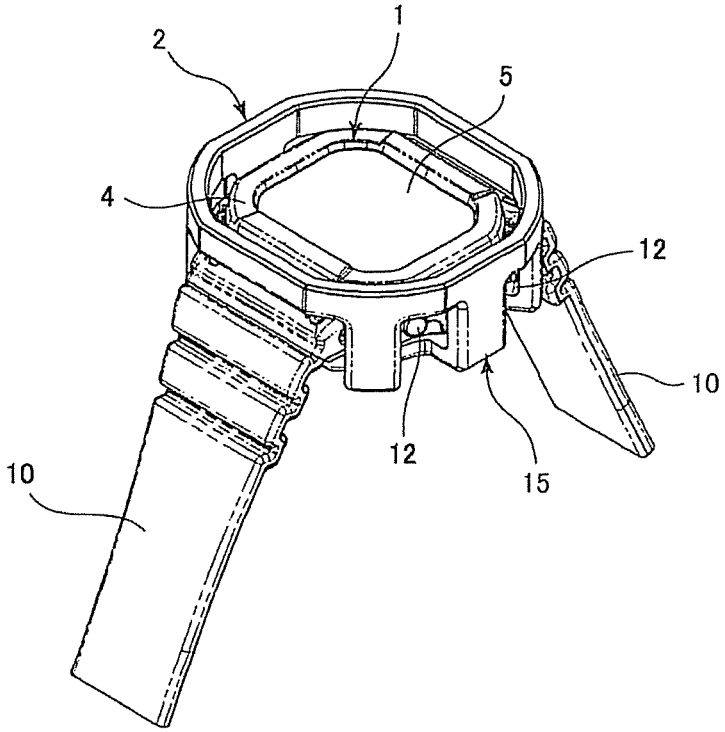
FIG. 1 is a perspective view of a wristwatch according to a first embodiment of the present invention.
Figure 2:
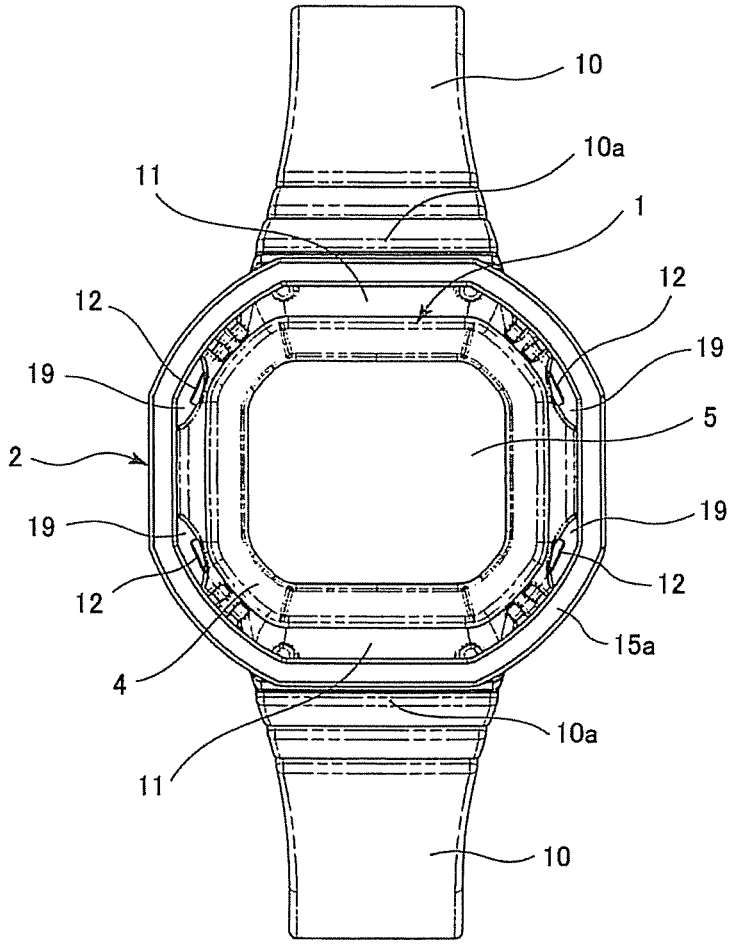
FIG. 2 is an enlarged planar view of the wristwatch in FIG. 1 when viewed from above.
Figure 3:
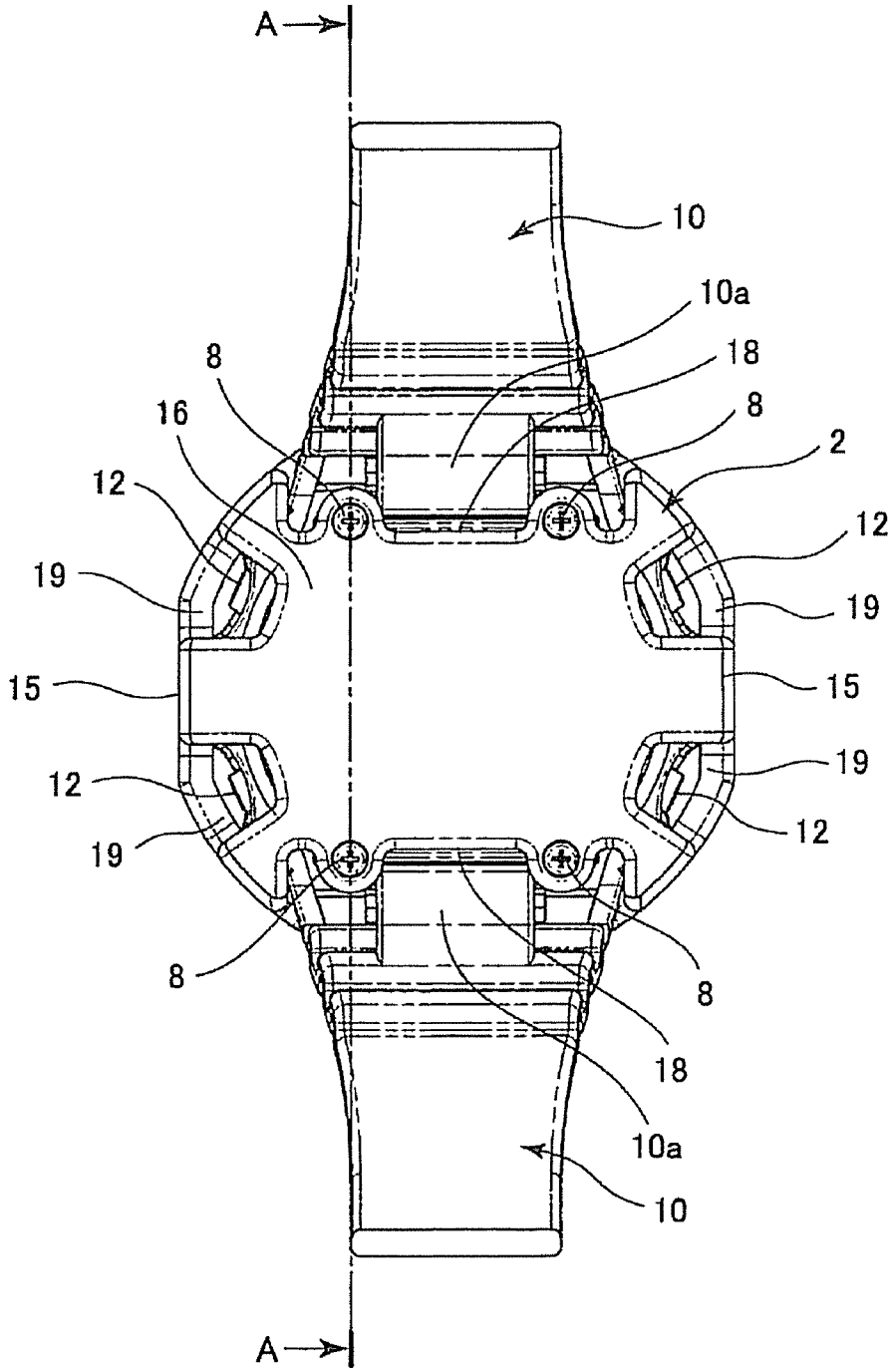
FIG. 3 is an enlarged rear view of the wristwatch in FIG. 1 when viewed from below.

As shown in FIG. 1 to FIG. 3, this wristwatch includes a wristwatch case 1 and a shock absorbing member 2 surrounding the wristwatch case 1. The wristwatch case 1 is constituted by a case body 3 and a bezel 4 covering the outer surface of the case body 3, as shown in FIG. 4.

Figure 4:
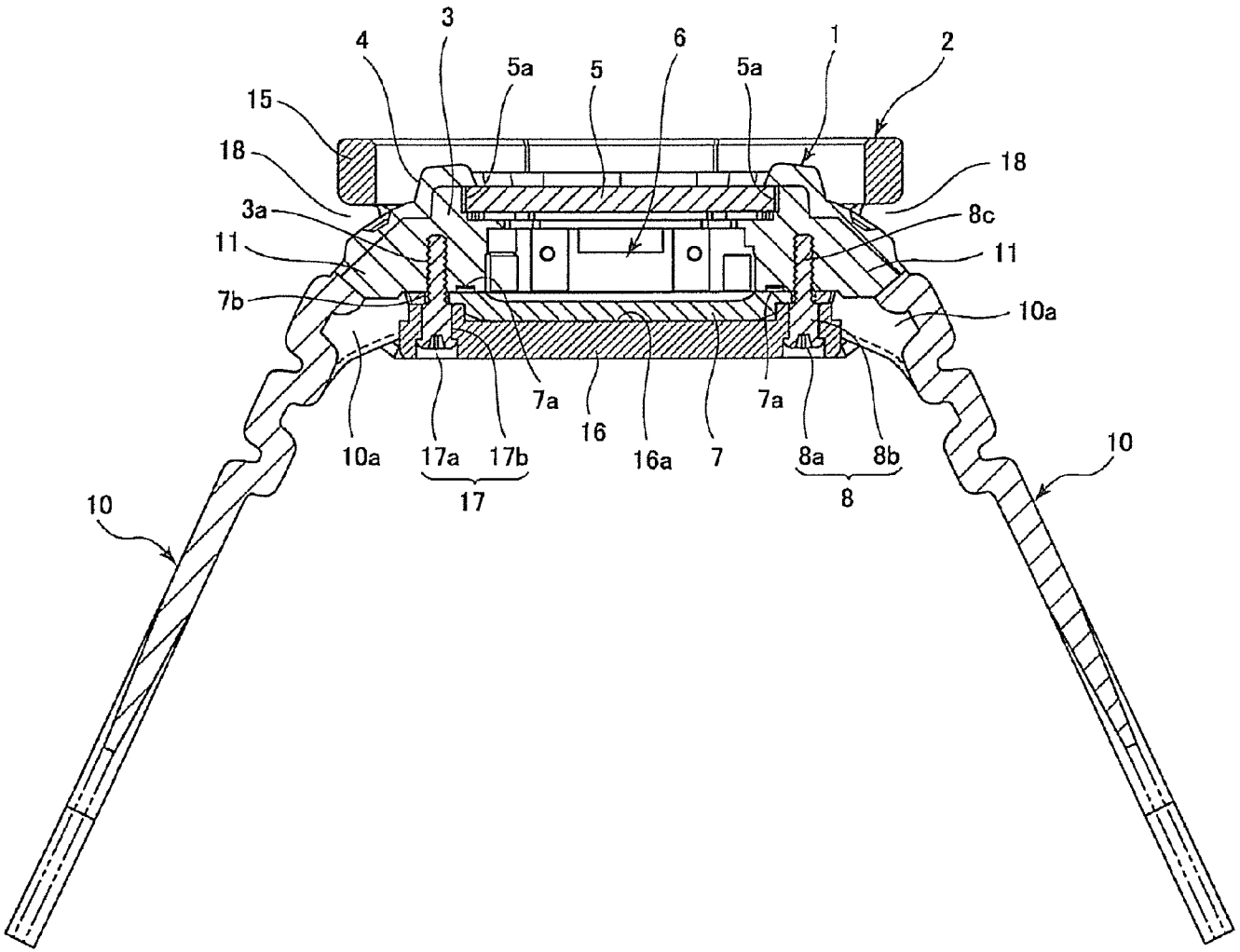
FIG. 4 is an enlarged cross-sectional view of the wristwatch taken along line A-A in FIG. 3.

As shown in FIG. 4, a watch crystal 5 is attached to the upper opening of the case body 3 with a gasket 5*a* therebetween. The bezel 4 covering the outer surface of the case body 3 is made of a flexible synthetic resin and provided on the outer surface of the case body 3 such that the inner circumferential edge of its upper portion covers the top surface of the outer circumferential end portion of the watch crystal 5.

Also, as shown in FIG. 4, a timepiece module 6 is provided inside the case body 3. This timepiece module 6 includes various components (not shown) required for a clock function, such as a timepiece movement that moves the hands to indicate time, and a flat display panel that electro-optically displays information such as time. In addition, a case back 7 is attached to the lower portion of the case body 3 by screw members 8 described hereafter with a waterproofing ring 7*a* therebetween.

Figure 5:
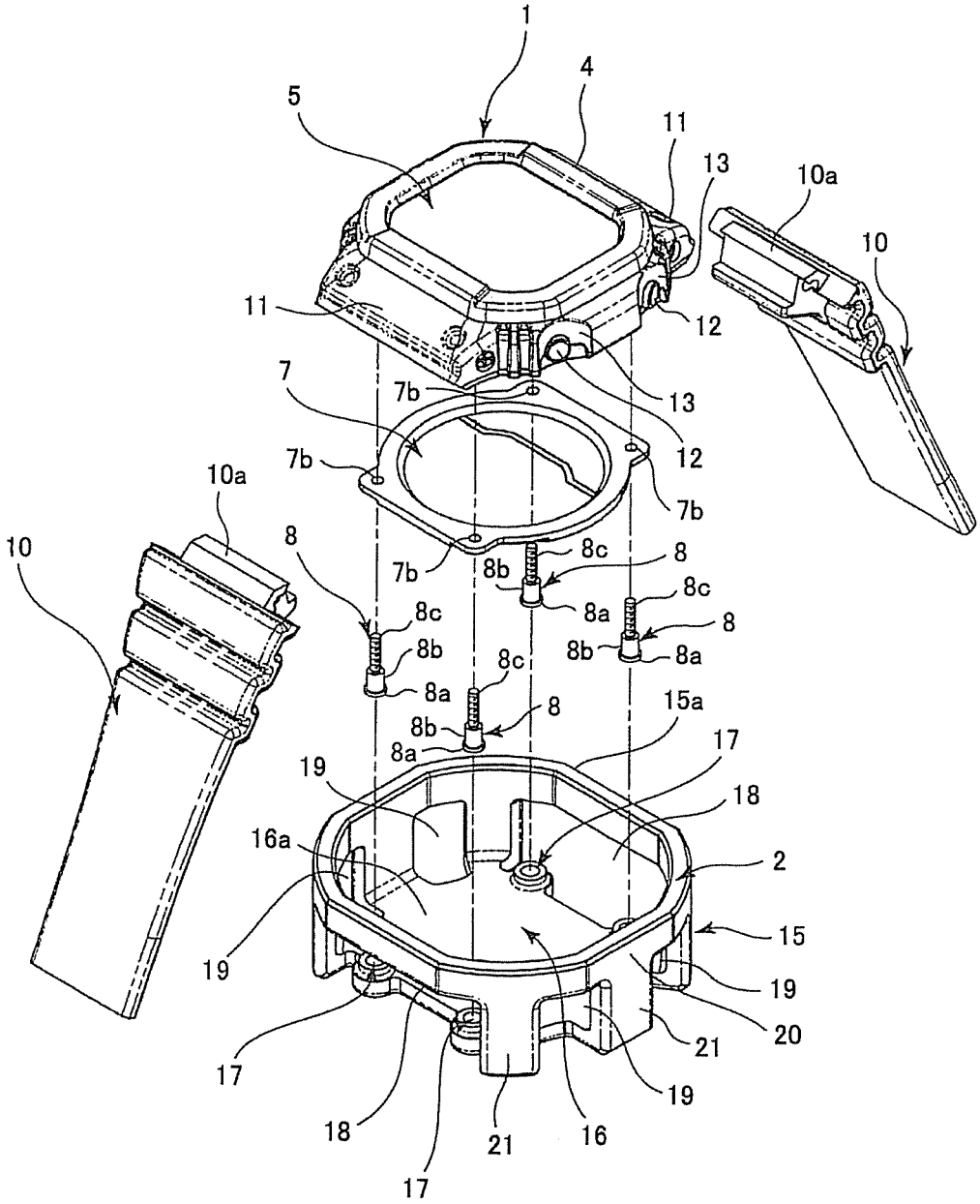
FIG. 5 is an enlarged and exploded perspective view of the wristwatch shown in FIG. 1.

Moreover, as shown in FIG. 1 to FIG. 5, watch bands 10 are respectively attached to the side portions of the wristwatch case 1 corresponding to the 12 o'clock and the 6 o'clock positions. That is, as shown in FIG. 4 and FIG. 5, band attaching portions 11 are provided projecting from the side portions of the wristwatch case 1 positioned at the 12 o'clock and the 6 o'clock positions, and attaching portions 10*a* provided at the end portions of the watch bands 10 are attached to the band attaching portions 11 of the wristwatch case 1, respectively.

Furthermore, as shown in FIG. 1 to FIG. 5, a plurality of switch buttons 12 are respectively provided in the side portions of the wristwatch case 1 corresponding to the 2 o'clock, 4 o'clock, 8 o'clock, and 10 o'clock positions. In this instance, as shown in FIG. 3 and FIG. 5, a semicircular arc-shaped notched recess portion 13 is provided in each of the side portions of the wristwatch case 1 corresponding to the 2 o'clock, 4 o'clock, 8 o'clock, and 10 o'clock positions. As a result, the switch buttons 12 are respectively arranged in the notched recess portions 13 of the wristwatch case 1 with being exposed to the outside.

The shock absorbing member 2 is made of a flexible synthetic resin such as thermoplastic polyurethane resin, and includes a peripheral side portion 15 surrounding the wristwatch case 1 and a bottom portion 16 to which the case back 7 is attached, as shown in FIG. 1 to FIG. 5. As shown in FIG. 1 and FIG. 5, the peripheral side portion 15 of the shock absorbing member 2 has a roughly cylindrical shape that is circular or polygonal such as octagonal and corresponds to the outer shape of the wristwatch case 1.

As shown in FIG. 1 and FIG. 4, the height of the peripheral side portion 15 is formed higher than the thickness of the wristwatch case 1, and accordingly a top end surface 15*a* of the peripheral side portion 15 projects above the wristwatch case 1. In addition, as shown in FIG. 3 to FIG. 5, the bottom portion 16 of the shock absorbing member 2 is provided with a case back mounting recess portion 16*a* in which the case back 7 is arranged, and a plurality of screw insertion holes 17 into which screw members 8 are inserted to attach the case back 7 and the wristwatch case 1 to the case back mounting recess portion 16*a*.

That is, as shown in FIG. 4 and FIG. 5, the screw insertion holes 17 are provided in the four corners of the bottom portion 16 corresponding to attachment holes 7*b* provided in the four corners of the case back 7. In this instance, as shown in FIG. 4, the screw insertion hole 17 is a stepped through-hole, of which the lower portion is formed into a large diameter portion 17*a* and the upper portion is formed into a small diameter portion 17*b*. In addition, as shown in FIG. 4 and FIG. 5, the screw member 8 is a stepped screw having a head portion 8*a*, a neck portion 8*b* with a diameter smaller than that of the head portion 8*a*, and a screw portion 8*c* with a diameter further smaller than that of the neck portion 8*b*.

As shown in FIG. 4, when the screw portion 8 is inserted into the screw insertion hole 17 from the underside of the bottom portion 16 of the shock absorbing member 2, the head portion 8*a* is arranged within the large diameter portion 17*a* in the lower portion of the screw insertion hole 17 in the bottom portion 16, the neck portion 8*b* is arranged within the small diameter portion 17*b* in the upper portion of the screw insertion hole 17, and the screw portion 8*c* is screwed into a screw hole 3*a* in the case body 3 after passing through the attachment hole 7*b* in the case back 7.

As a result, as shown in FIG. 4, when the screw portion 8*c* is screwed into the screw hole 3*a* of the case body 3 and tightened, the head portion 8*a* presses the bottom portion 16 of the shock absorbing member 2 against the case back 7, and the neck portion 8*b* presses the case back 7 against the undersurface of the wristwatch case 1, whereby the screw member 8 fixes the case back 7 to the wristwatch case 1, and fixes the case back 7 and the wristwatch case 1 to the bottom portion 16 of the shock absorbing member 2.

Also, as shown in FIG. 1 to FIG. 5, the peripheral side portion 15 of the shock absorbing member 2 is provided with band holes 18 into which the watch bands 10 are inserted. These band holes 18 respectively correspond to two positions in the wristwatch case 1, the 12 o'clock position and the 6 o'clock position. That is, as shown in FIG. 1 and FIG. 5, the band hole 18 has a horizontally elongated rectangular shape that is almost the same as the cross-sectional shape of the attaching portion 10*a* in the end portion of the watch band 10, and is formed from an area in the peripheral side portion 15 of the shock absorbing member 2 under the top end surface 15*a*, namely the area corresponding to the band attaching portion 11 of the wristwatch case 1, to the bottom portion 16.

Moreover, as shown in FIG. 1 to FIG. 5, the peripheral side portion 15 of the shock absorbing member 2 is provided with switch operation holes 19 corresponding to the switch buttons 12. These switch operation holes 19 respectively correspond to four positions in the wristwatch case 1, the 2 o'clock position, the 4 o'clock position, the 8 o'clock position, and the 10 o'clock position. As shown in FIG. 1 to FIG. 5, the switch operation holes 19 have almost the same size as that of the semicircular notched recess portions 13 provided in the side portions of the wristwatch case 1 where the switch buttons 12 are positioned, and is sufficiently larger than the outer diameter of the switch button 12.

That is, as shown in FIG. 1 to FIG. 5, the switch insertion holes 19 are formed in areas respectively corresponding to the notched recess portions 13 of the wristwatch case 1, from the area under the top end surface 15*a* of the peripheral side portion 15 of the shock absorbing member 2 to the bottom portion 16. As a result, the switch buttons 12 can be operated from outside of the shock absorbing member 2 through the switch operation holes 19.

In addition, as shown in FIG. 5, because the top end surface 15*a* of the peripheral side portion 15 projects above the wristwatch case 1 and is formed continuously in the circumferential direction, the shock absorbing member 2 is structured such that the upper portion of the peripheral side portion 15 forms a roughly ring-shaped bumper portion 20. This bumper portion 20 prevents the peripheral side portion 15 from collapsing inward.

Figure 7:
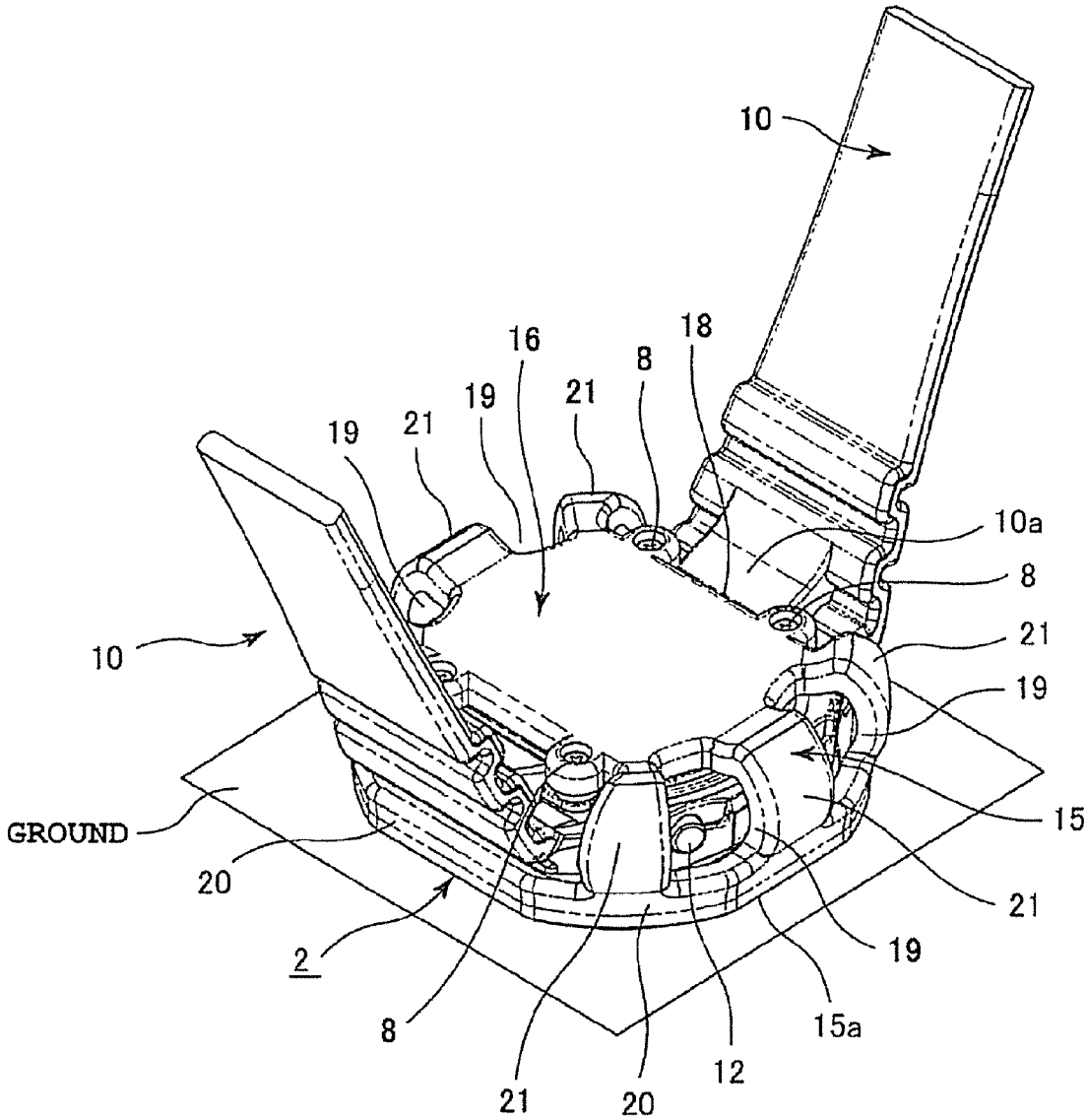
Figure 8:
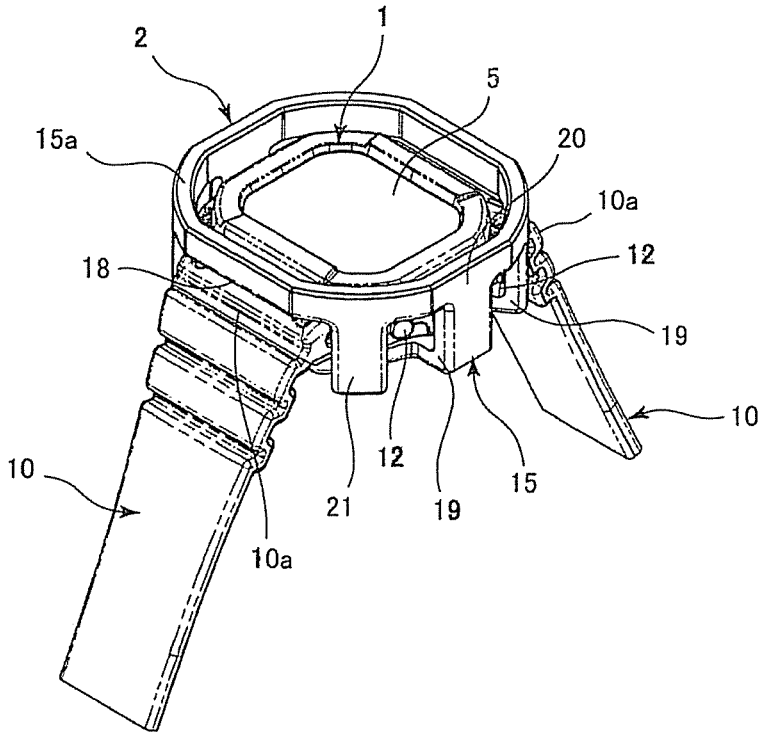
FIG. 8 is a perspective view of a wristwatch according to a second embodiment of the present invention.

Moreover, as a result of the two band holes 18 and the four switch operation holes 19 being formed in the peripheral side portion 15, the shock absorbing member 2 is structured such that the peripheral side portion 15 has a plurality of rib portions 21, as shown in FIG. 5. When a large load is applied to the top end surface 15*a* of the peripheral side portion 15, that is, when a large load is applied to the tip surface of the bumper portion 20, each rib portion 21 of the peripheral side portion 15 elastically deforms to a convex curved shape toward the outside, as shown in FIG. 7.

Next, the assembling of the wristwatch will be described.

In this instance, first, the wristwatch case 1 is assembled as shown in FIG. 4 and FIG. 5. At this time, the watch crystal 5 is mounted on the upper opening of the case body 3 of the wristwatch case 1, and after the bezel 4 is attached to the outer surface of the case body 3, the timepiece module 6 is assembled in the case body 3.

Then, in a state in which the case back 7 is placed on the bottom surface of the wristwatch case 1 as shown in FIG. 5, the wristwatch case 1 and the case back 7 are placed inside the peripheral side portion 15 of the shock absorbing member 2 as shown in FIG. 1 and FIG. 4. At this time, as shown in FIG. 5, each of the band attaching portions 11 positioned at the 12 o'clock and 6 o'clock positions of the wristwatch case 1 is placed corresponding to each band hole 18 in the peripheral side portion 15 of the shock absorbing member 2. In addition, the switch buttons 12 positioned at the 2 o'clock, 4 o'clock, 8 o'clock, and 10 o'clock positions of the wristwatch case 1 are placed respectively corresponding to the switch operation holes 19 in the peripheral side portion 15 of the shock absorbing member 2.

In addition, at this time, as shown in FIG. 4 and FIG. 5, the case back 7 is mounted on the case back mounting recess portion 16*a* provided in the bottom portion 16 of the shock absorbing member 2, and the attachment holes 7*b* in the case back 7 are placed corresponding to the screw insertion holes 17 provided in the bottom portion 16 of the shock absorbing member 2. In this state, as shown in FIG. 4, the case back 7 and the wristwatch case 1 are attached to the bottom portion 16 of the shock absorbing member 2 by the screw members 8.

That is, as shown in FIG. 4, the screw members 8 are inserted into the screw insertion holes 17 from the underside of the bottom portion 16. At this time, the head portion 8*a* is inserted into the large diameter portion 17*a* in the lower portion of the screw insertion hole 17 in the bottom portion 16, the neck portion 8*b* is inserted into the small diameter portion 17*b* in the upper portion of the screw insertion hole 17, and the screw portion 8*c* is inserted into the attachment hole 7*b* in the case back 7 and screwed into the screw hole 3*a* in the case body 3.

In this state, the head portion 8*a* of the screw member 8 is tightened and the screw portion 8*c* is screwed into the screw hole 3*a* of the case body 3. As a result, the head portion 8*a* presses the bottom portion 16 of the shock absorbing member 2 against the case back 7, and the neck portion 8*b* presses the case back 7 against the undersurface of the wristwatch case 1. As a result, as shown in FIG. 4, the case back 7 is fixed to the wristwatch case 1 by the screw members 8, and the wristwatch case 1 and the case back 7 are fixed to the bottom portion 16 of the shock absorbing member 2.

Then, as shown in FIG. 1 and FIG. 5, the watch band 10 is attached to the wristwatch case 1 after passing through the band hole 18 in the peripheral side portion 15 of the shock absorbing member 2. That is, the attaching portion 10*a* at the end portion of the watch band 1 is inserted into the band hole 18 in the peripheral side portion 15 of the shock absorbing member 2 and placed corresponding to the band attaching portion 11 of the wristwatch case 1. Then, as shown in FIG. 4, it is attached to the band attaching portion 11 of the wristwatch case 1.

As a result, as shown in FIG. 1 to FIG. 4, the watch band 10 attached to the band attaching portion 11 of the wristwatch case 1 extends to the outside of the peripheral side portion 15 through the band hole 18 in the peripheral side portion 15 of the shock absorbing member 2. In addition, as shown in FIG. 1 and FIG. 2, the wristwatch case 1 is fixed being embedded in the peripheral side portion 15 of the shock absorbing member 2, along with the case back 1.

That is, in the state where the wristwatch case 1 has been fixed inside the peripheral side portion 15 of the shock absorbing body 2, the top end surface 15*a* of the bumper portion 20, which is positioned at the upper portion of the peripheral side portion 15 of the shock absorbing member 2, projects further upwards than the top surface of the wristwatch case 1, as shown in FIG. 1 to FIG. 4. In addition, as shown in FIG. 1, the switch buttons 12 are respectively aligned with the switch operation holes 19 in the peripheral side portion 15 of the shock absorbing member 2 and exposed to the outside, whereby switch operation can be performed from outside of the shock absorbing member 2.

Next, the effects of a wristwatch such as that described above will be described.

Ordinarily, the wristband case 1 is used by being worn on a wrist using the watch bands 10, along with the shock absorbing member 2. In this state, as shown in FIG. 1 and FIG. 2, information such as the time can be viewed from above the peripheral side portion 15 of the shock absorbing member 2, through the watch crystal 5 of the wristwatch case 1. In addition, the switch buttons 12 can be operated through the switch operation holes 19 provided in the peripheral side portion 15 of the shock absorbing member 2.

Figure 6:
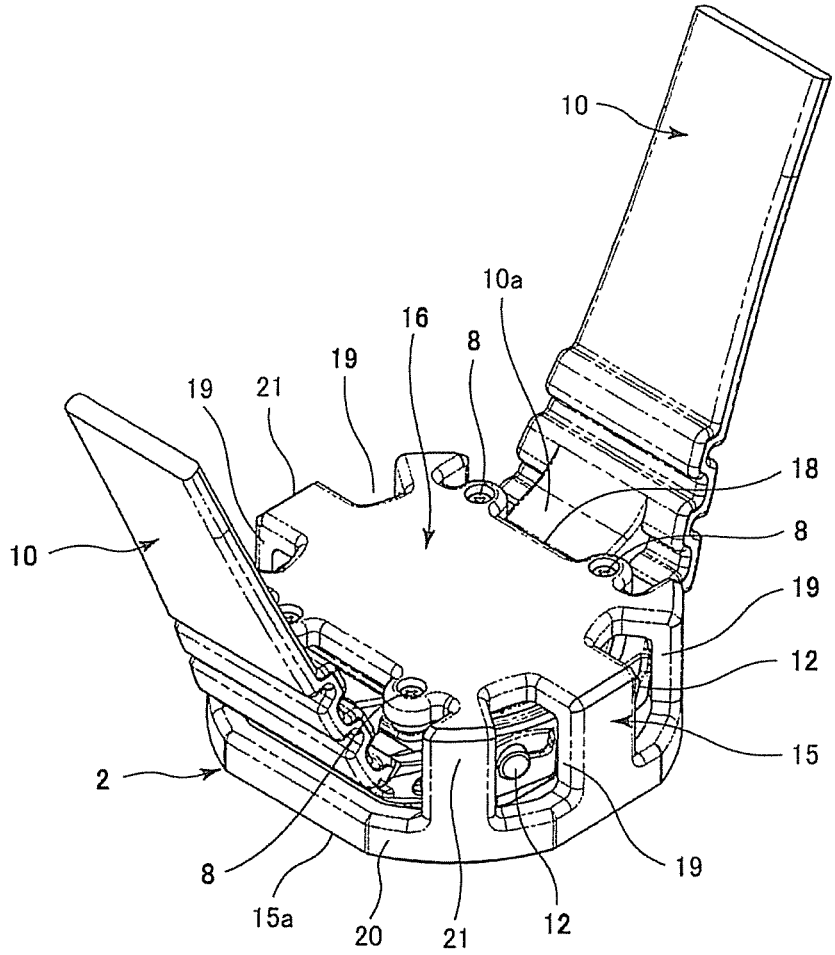
FIG. 6 is an enlarged perspective view of the wristwatch shown in FIG. 1 while the wristwatch is falling from a high place.

When the wristwatch is accidentally dropped from a high place such as a building (for example, from a height of about 10 m above ground), as shown in FIG. 6, the watch bands 10 encounter air resistance, whereby the wristwatch case 1 falls with the watch crystal 5 facing downward and the case back 7 facing upward. Then, when the wristwatch hits the ground or the like in this state, as shown in FIG. 7, the top end surface 15*a* of the bumper portion 20 over the peripheral side portion 15 of the shock absorbing member 2, which is projecting further outward than the top surface of the wristwatch case 1 (bottom surface in FIG. 7), receives a strong shock.

When the top end surface 15*a* of the bumper portion 20 over the peripheral side portion 15 of the shock absorbing member 2 receives shock in this way, a strong inertia force caused by gravitational force accompanying the fall is generated in the wristwatch case 1 fixed to the bottom portion 16 of the shock absorbing member 2 via the case back 7, as a result of the shock. That is, when the top end surface 15*a* of the bumper portion 20 over the peripheral side portion 15 of the shock absorbing member 2 hits the ground, a strong inertia force that causes the wristwatch case 1 to rapidly fall is generated in the wristwatch case 1 by the shock received by the shock absorbing member 2.

At this time, because the wristwatch case 1 is, via the case back 7, attached and fixed to the bottom portion 16 of the shock absorbing member 2 by the screw members 8, the bottom portion 16 of the shock absorbing member 2 is pulled downward by the strong inertia force generated in the wristwatch case 1. As a result, the peripheral side portion 15 of the shock absorbing member 2 elastically deforms to a convex curved shape toward the outside as shown in FIG. 7.

That is, because the shock absorbing member 2 is made of a flexible synthetic resin such as thermoplastic polyurethane, and its peripheral side portion 15 includes the rib portions 21 as a result of being provided with the band holes 18 into which the watch bands 10 are inserted and the switch operation holes 19 corresponding to the switch buttons 12, when the shock absorbing member 2 receives shock and its bottom portion 16 is pulled downward by a strong inertia force generated thereby in the wristwatch case 1, its peripheral side portion 15 elastically deforms along with this action without fail.

At this time, because the top end surface 15*a* of the bumper portion 20 over the peripheral side portion 15 of the shock absorbing member 2 is projecting further outward than the top surface of the wristwatch case 1 (bottom surface in FIG. 7), the top surface of the wristwatch case 1 (bottom surface in FIG. 7) does not come into contact with the ground and directly receive the shock even when the peripheral side portion 15 of the shock absorbing member 2 is elastically deformed. Accordingly, even when the wristwatch receives a strong shock of falling from a high place or the like, the shock is reliably and unfailingly absorbed by the shock absorbing member 2, whereby the watch crystal 5 and the internal timepiece module 6 are prevented from being damaged.

In this case, because the upper portion of the peripheral side portion 15 of the shock absorbing member 2 is formed as the bumper portion 20 as a result of the top end surface 15*a* projecting above the wristwatch case 1 and being formed continuously in the circumferential direction, the peripheral side portion 15 is prevented from collapsing inward by the bumper portion 20. Accordingly, when the wristwatch receives a strong shock of falling or the like, the peripheral side portion 15 can be elastically deformed outward without fail, whereby the wristwatch case 1 is prevented from being damaged.

In addition, the peripheral side portion 15 of the shock absorbing member 2 elastically deforms and unfailingly absorbs shock not only when the wristwatch falls from a high place but also, for example, when an object falls from a high place above the wristwatch with the watch crystal 5 of the wristwatch case 1 facing upward, and hits the top end surface 15*a* of the peripheral side portion 15 of the shock absorbing member 2. Accordingly, in cases such as this as well, the wristwatch case 1 is prevented from being damaged.

In this instance as well, because the top end surface 15*a* of the bumper portion 20 over the peripheral portion 15 of the shock absorbing member 2 is projecting further outward than the top surface of the wristwatch case 1, the object falling from a high place does not hit the top surface of the wristwatch case 1 when the peripheral side portion 15 of the shock absorbing member 2 is elastically deformed. Accordingly, even when the wristwatch receives a strong shock from an object that has fallen from a high place, the shock is reliably and unfailingly absorbed by the shock absorbing member 2, whereby the watch crystal 5 and the internal timepiece module 6 are prevented from being damaged.

As just described, the wristwatch is structured such that the shock absorbing member 2 made of a flexible resin includes the peripheral side portion 15 surrounding the wristwatch case 1 and projecting further outward than the top surface of the wristwatch case 1, and the bottom portion 16 to which the case back 7 on the back surface of the wristwatch case 1 is attached. In addition, the peripheral side portion 15 is provided with the band holes 18 into which the watch bands 10 are inserted, and the switch operation holes 19 corresponding to the switch buttons 12. Accordingly, when the top end surface 15*a* of the peripheral side portion 15 of the shock absorbing member 2 receives a strong shock of falling from a high place or the like, the peripheral side portion 15 can absorb the shock by elastic deformation. As a result, even when a strong shock of falling from a high place or the like is received, the shock is unfailingly absorbed, whereby the wristwatch case 1 is prevented from being damaged.

That is, when this wristwatch is dropped from a high place, the wristwatch case 1 falls turning the case back 7 upward, and when it hits the ground in this state, the top end surface 15*a* of the peripheral side portion 15 of the shock absorbing member 2 made of a flexible resin, which is projecting further outward than the top surface of the wristwatch case 1, receives a strong shock, and a strong inertia force is generated thereby in the wristwatch case 1 fixed to the bottom portion 16 of the shock absorbing member 2 via the case back 7. Then, because of the inertia force, the bottom portion 16 of the shock absorbing member 2 is pulled downward, and the peripheral side portion 15 of the shock absorbing member 2 is elastically deformed thereby. Therefore, even when a strong shock of falling from a high place or the like is received, the shock is reliably and unfailingly absorbed by the peripheral side portion 15 of the shock absorbing member 2.

In this instance, the wristwatch has the screw members 8 used to attach the case back 7 to the wristwatch case 1, and because of the case back 7 and the wristwatch case 1 being fixed to the bottom portion 16 of the shock absorbing member 2 by these screw members 8, when the top end surface 15*a* of the peripheral side portion 15 of the shock absorbing member 2 receives a strong shock of falling and a strong inertia force is generated in the wristwatch case 1, the bottom portion 16 of the shock absorbing member 2 is pulled downward by the inertia force. Since the strong inertia force in the wristwatch case 1 accompanying the shock is unfailingly transmitted to the peripheral side portion 15 of the shock absorbing member 2, the peripheral side portion 15 of the shock absorbing member 2 is elastically deformed without fail.

Also, the peripheral side portion 15 of the shock absorbing member 2 includes the rib portions 21 as a result of being provided with the band holes 18 into which the watch bands 10 are inserted, and the switch operation holes 19 corresponding to the switch buttons 12. Accordingly, when the strong inertia force generated in the wristwatch case 1 by the shock of falling is transmitted to the peripheral side portion 15 of the shock absorbing member 2, the peripheral side portion 15 of the shock absorbing member 2 elastically deforms without fail, in response to the inertia force.

In this instance, because the upper portion of the peripheral side portion 15 of the shock absorbing member 2 is formed as the bumper portion 20 as a result of the top end surface 15*a* projecting above the wristwatch case 1 and being formed continuously in the circumferential direction, the peripheral side portion 15 is prevented from collapsing inward by the bumper portion 20. As a result, when the wristwatch receives a shock of falling or the like, the peripheral side portion 15 of the shock absorbing member 2 elastically deforms outward without fail, whereby the wristwatch case 1 is prevented from being damaged.

Second Embodiment

Next, a second embodiment of a wristwatch to which the present invention has been applied will be described with reference to FIG. 8 to FIG. 12. Note that parts and portions that are the same as those of the first embodiment shown in FIG. 1 to FIG. 7 are described with the same reference numerals.

Figure 9:
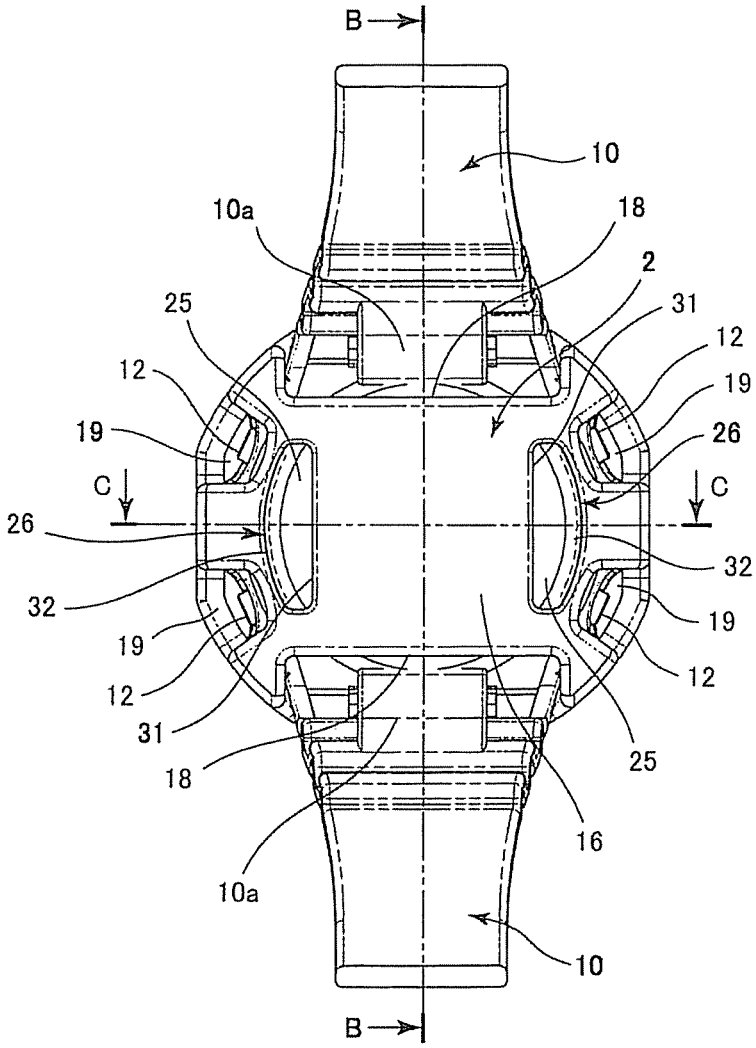
FIG. 9 is an enlarged rear view of the wristwatch in FIG. 8 when viewed from below.
Figure 11:
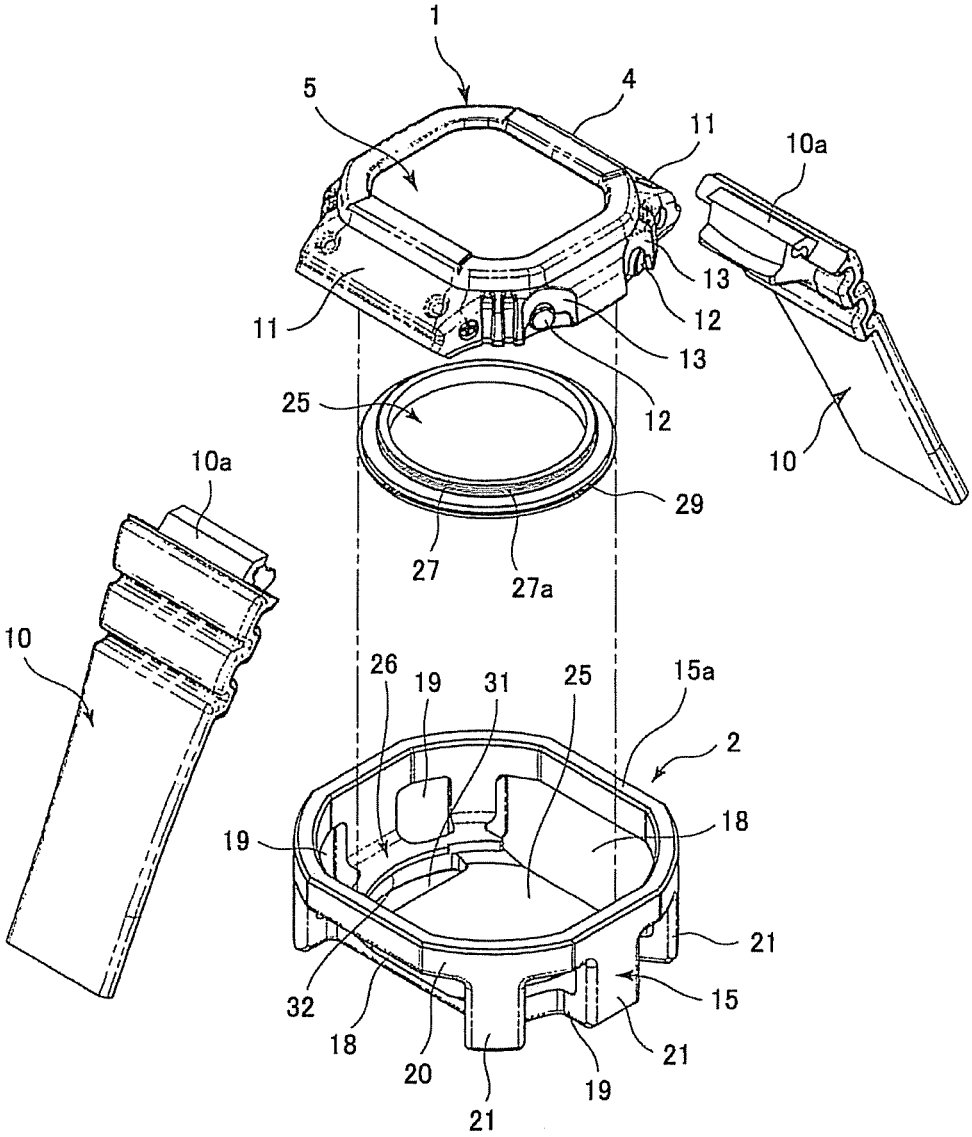
FIG. 11 is an enlarged and exploded perspective view of the wristwatch shown in FIG. 8.
Figure 12:
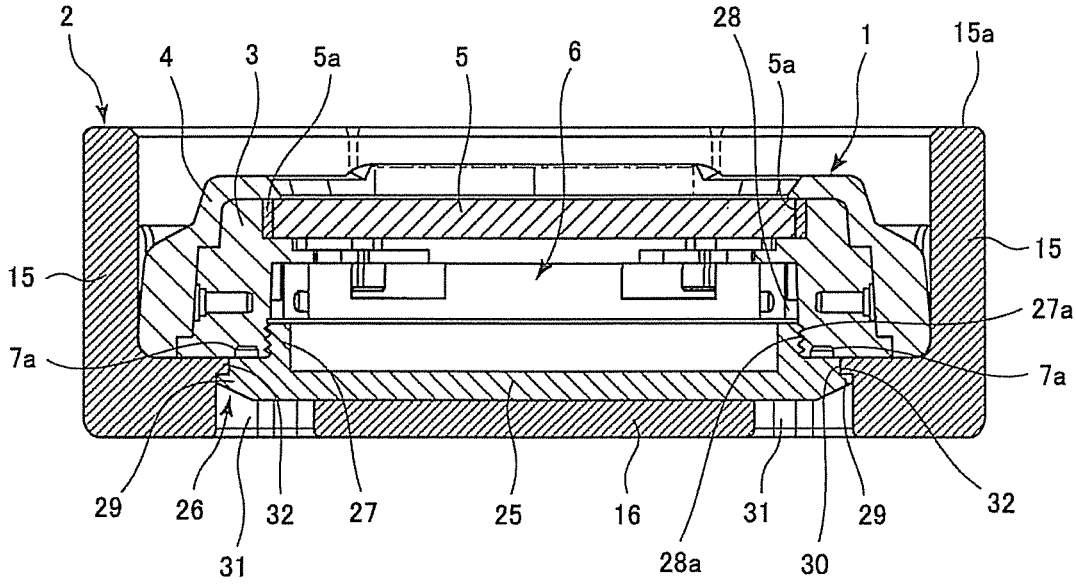
FIG. 12 is an enlarged cross-sectional view of the wristwatch taken along line C-C in FIG. 9.

As shown in FIG. 9, FIG. 11, and FIG. 12, the wristwatch is structured such that a case back 25 is attached by being screwed into the lower portion of the wristwatch case 1, and accordingly a case back fixing portion 26 is provided to fix the case back 25 to the bottom surface 16 of the shock absorbing member 2. The structure of the second embodiment is similar to that of the first embodiment except for this feature.

Figure 10:
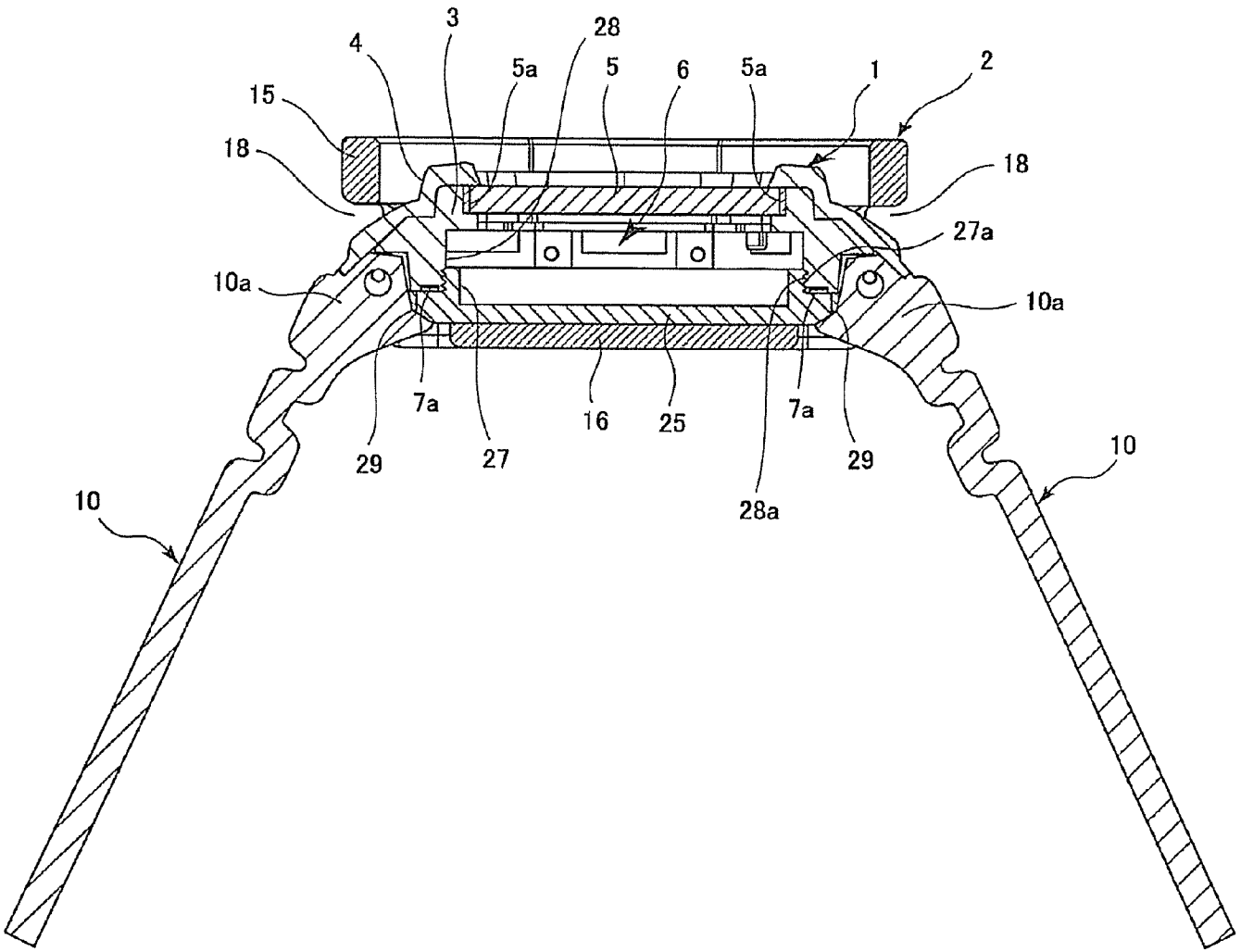
FIG. 10 is an enlarged cross-sectional view of the wristwatch taken along line B-B in FIG. 9.

Specifically, the case back 25 is formed into a roughly circular plate shape as shown in FIG. 11, and a ring portion 27 that is inserted into a lower opening portion 28 of the wristwatch case 1 is formed on the top surface of the case back 25 as shown in FIG. 10 to FIG. 12. As shown in FIG. 11, a male thread 27*a* is provided on the outer circumferential surface of the ring portion 27 and, as shown in FIG. 10, a female thread

28*a* that engages with the male thread 27*a* is provided on the inner circumferential surface of the lower opening portion 28 of the wristwatch case 1.

Accordingly, as shown in FIG. 10 and FIG. 12, the male thread 27*a* on the ring portion 27 engages with the female thread 28*a* on the inner circumferential surface of the lower opening portion 28 of the wristwatch case 1 by the case back 25 being rotated while the ring portion 27 is being inserted into the lower opening portion 28 of the wristwatch case 1 from the underside of the wristwatch case 1. As a result, the case back 25 is attached to the lower portion of the wristwatch case 1.

Also, in the outer circumferential portion of the case back 25, a ring-shaped flanged projection portion 29 is formed projecting continuously along the outer circumference of the case back 25, as shown in FIG. 10 to FIG. 12. As shown in FIG. 10 and FIG. 12, this flanged projection portion 29 is structured such that a gap 30 (see FIG. 12) is formed between the flanged projection portion 29 and the bottom surface of the outer circumference of the wristwatch case 1 when the case back 25 is attached to the lower portion of the wristwatch case 1.

On the other hand, as shown in FIG. 9, FIG. 11, and FIG. 12, the case back fixing portion 26 used to fix the case back 25 is provided in the bottom portion 16 of the shock absorbing member 2. This case back fixing portion 26 is structured having roughly crescent-shaped opening portions 31 perforating in the vertical direction at the 3 o'clock and 9 o'clock positions in the bottom portion 16 of the shock absorbing member 2. An engaging projection portion 32 is provided in the upper edge portion on the inner circumferential surface of the opening portion 31.

Accordingly, as shown in FIG. 9 to FIG. 12, when the case back 25 attached to the lower portion of the wristwatch case 1 is placed in the bottom portion 16 of the shock absorbing member 2 and pressed against the bottom portion 16, the engaging projection portion 32 provided at the upper edge portion of the inner circumferential surface of the opening portion 31 is inserted and fitted into the gap 30 formed between the flanged projection portion 29 of the case back 25 and the bottom surface of the outer circumference of the wristwatch case 1, as shown in FIG. 12. As a result, the case back 25 is fixed to the bottom portion 16 of the shock absorbing member 2 by the case back fixing portion 26, along with the wristwatch case 1.

Next, the effects of a wristwatch such as that described above will be described.

As in the case of the first embodiment, ordinarily, this wristwatch is used by the wristband case 1 being worn on a wrist using the watch bands 10, along with the shock absorbing member 2. In this state, as in the case of the first embodiment, information such as the time can be viewed from above the peripheral side portion 15 of the shock absorbing member 2, through the watch crystal 5 of the wristwatch case 1. In addition, the switch buttons 12 can be operated through the switch operation holes 19 provided in the peripheral side portion 15 of the shock absorbing member 2.

Moreover, as in the case of the first embodiment, when the wristwatch is accidentally dropped from a high place such as a building (for example, from a height of about 10 m above ground), the watch bands 1 encounter air resistance, whereby the wristwatch case 1 falls with the watch crystal 5 facing downward and the case back 25 facing upward. Then, when the wristwatch hits the ground or the like in this state, the top end surface 15*a* of the bumper portion 20 over the peripheral side portion 15 of the shock absorbing member 2, which is projecting further outward than the top surface of the wristwatch case 1, receives a strong shock.

When the top end surface 15*a* of the bumper portion 20 over the peripheral side portion 15 of the shock absorbing member 2 receives shock in this way, as in the case of the first embodiment, a strong inertia force caused by gravitational force accompanying the fall is generated in the wristwatch case 1 fixed to the bottom portion 16 of the shock absorbing member 2 via the case back 25, as a result of the shock. At this time, because the wristwatch case 1 is, via the case back 25, fixed to the bottom portion 16 of the shock absorbing member 2 by the case back fixing portion 26 provided in the bottom portion 16 of the shock absorbing member 2, the bottom portion 16 of the shock absorbing member 2 is pulled downward by the strong inertia force generated in the wristwatch case 1. As a result, the peripheral side portion 15 of the shock absorbing member 2 elastically deforms to a convex curved shape toward the outside as shown in FIG. 7.

At this time as well, because the top end surface 15*a* of the bumper portion 20 over the peripheral side portion 15 of the shock absorbing member 2 is projecting further outward than the top surface of the wristwatch case 1, the top surface of the wristwatch case 1 (bottom surface in FIG. 7) does not come into contact with the ground and directly receive the shock even when the peripheral side portion 15 of the shock absorbing member 2 is elastically deformed, as in the case of the first embodiment. Accordingly, even when the wristwatch receives a strong shock of falling from a high place or the like, the shock is reliably and unfailingly absorbed, whereby the watch crystal 5 and the internal timepiece module 6 are prevented from being damaged.

Furthermore, in this wristwatch as well, the peripheral side portion 15 of the shock absorbing member 2 elastically deforms and unfailingly absorbs shock not only when the wristwatch falls from a high place but also, for example, when an object falls from a high place above the wristwatch with the watch crystal 5 of the wristwatch case 1 facing upward, and hits the top end surface 15*a* of the peripheral side portion 15 of the shock absorbing member 2. Accordingly, in cases such as this as well, the wristwatch case 1 is prevented from being damaged.

In this instance as well, because the top end surface 15*a* of the bumper portion 20 over the peripheral portion 15 of the shock absorbing member 2 is projecting further outward than the top surface of the wristwatch case 1, the object falling from a high place does not hit the top surface of the wristwatch case 1 when the peripheral side portion 15 of the shock absorbing member 2 is elastically deformed. Accordingly, even when the wristwatch receives a strong shock from an object that has fallen from a high place, the shock is reliably and unfailingly absorbed by the shock absorbing member 2, whereby the watch crystal 5 and the internal timepiece module 6 are prevented from being damaged.

As in the case of the first embodiment, this wristwatch is, as described above, structured such that the shock absorbing member 2 made of a flexible resin includes the peripheral side portion 15 surrounding the wristwatch case 1 and projecting further outward than the top surface of the wristwatch case 1, and the bottom portion 16 to which the case back 25 on the back surface of the wristwatch case 1 is attached. In addition, the peripheral side portion 15 is provided with the band holes 18 into which the watch bands 10 are inserted, and the switch operation holes 19 corresponding to the switch buttons 12. Accordingly, when the top end surface 15*a* of the peripheral side portion 15 of the shock absorbing member 2 receives a strong shock of falling from a high place or the like, the peripheral side portion 15 can absorb the shock by elastic deformation. As a result, even when a strong shock of falling from a high place or the like is received, the shock is unfailingly absorbed, whereby the wristwatch case 1 is prevented from being damaged.

That is, as in the case of the first embodiment, when this wristwatch is dropped from a high place, the wristwatch case 1 falls turning the case back 25 upward, and when it hits the ground in this state, the top end surface 15*a* of the peripheral side portion 15 of the shock absorbing member 2 made of a flexible resin, which is projecting further outward than the top surface of the wristwatch case 1, receives a strong shock, and a strong inertia force is generated thereby in the wristwatch case 1 fixed to the bottom portion 16 of the shock absorbing member 2 via the case back 7. Then, because of the inertia force, the bottom portion 16 of the shock absorbing member 2 is pulled downward, and the peripheral side portion 15 of the shock absorbing member 2 is elastically deformed thereby. Therefore, even when a strong shock of falling from a high place or the like is received, the shock is reliably and unfailingly absorbed by the peripheral side portion 15 of the shock absorbing member 2.

In this instance, the bottom portion 16 of the shock absorbing member 2 is provided with the case back fixing portion 26 interposed between the wristwatch case 1 and the case back 25, and because of the case back 25 and the wristwatch case 1 being fixed to the bottom portion 16 of the shock absorbing member 2 by this case back fixing portion 26, when the top end surface 15*a* of the peripheral side portion 15 of the shock absorbing member 2 receives a strong shock of falling and a strong inertia force is generated in the wristwatch case 1, the bottom portion 16 of the shock absorbing member 2 is pulled downward by the inertia force. Since the strong inertia force in the wristwatch case 1 accompanying the shock is unfailingly transmitted to the peripheral side portion 15 of the shock absorbing member 2, the peripheral side portion 15 of the shock absorbing member 2 is elastically deformed without fail.

That is, when the case back 25 attached to the lower portion of the wristwatch case 1 is placed in the bottom portion 16 of the shock absorbing member 25 and pressed against the bottom portion 16, the engaging projection portion 32 provided at the upper edge portion of the inner circumferential surface of the opening portion 31 is inserted and fitted into the gap 30 formed between the ring-shaped flanged projection portion 29 provided in the case back 25 and the bottom surface of the outer circumference of the wristwatch case 1, whereby the case back 25 is firmly fixed to the bottom portion 16 of the shock absorbing member 2 by the case back fixing portion 26, along with the wristwatch case 1. As a result, the bottom portion 16 of the shock absorbing member 2 is pulled downward by the strong inertia force in the wristwatch case 1.

Also, in this wristwatch as well, the peripheral side portion 15 of the shock absorbing member 2 includes the rib portions 21 as a result of being provided with the band holes 18 into which the watch bands 10 are inserted, and the switch operation holes 19 corresponding to the switch buttons 12. Accordingly, when the strong inertia force generated in the wristwatch case 1 as a result of the shock of falling is transmitted to the peripheral side portion 15 of the shock absorbing member 2, the peripheral side portion 15 of the shock absorbing member 2 elastically deforms without fail, in response to the inertia force.

In this instance as well, because the upper portion of the peripheral side portion 15 of the shock absorbing member 2 is formed as the bumper portion 20 as a result of the top end surface 15*a* projecting above the wristwatch case 1 and being formed continuously in the circumferential direction, the peripheral side portion 15 is prevented from collapsing inward by the bumper portion 20. As a result, the peripheral side portion 15 of the shock absorbing member 2 elastically deforms outward without fail, whereby the wristwatch case 1 is prevented from being damaged.

While the present invention has been described with reference to the preferred embodiments, it is intended that the invention be not limited by any of the details of the description therein but includes all the embodiments which fall within the scope of the appended claims.

What is claimed is:

1. A wristwatch comprising:

a wristwatch case having a side portion provided with an operation member;

a case back attached to a back surface of the wristwatch case and which has an attachment hole;

a band attached to the side portion of the wristwatch case;

a shock absorbing member that is made of a flexible resin and includes a peripheral side portion surrounding the wristwatch case which projects further outward than a top surface of the wristwatch case and a bottom portion in which a screw insertion hole corresponding to the attachment hole of the case back is provided and to which the case back is attached, and the peripheral side portion is provided with a band hole where the band is inserted and an operation hole corresponding to the operation member; and a screw member for attaching the case back to the wristwatch case, wherein the band hole and the operation hole are respectively formed from an area under a top end surface of the peripheral side portion of the shock absorbing member to the bottom portion, and wherein the screw member is inserted into the attachment hole of the case back and the screw insertion hole of the bottom portion, and the case back is fixed to the bottom portion of the shock absorbing member, along with the wristwatch case.

2. The wristwatch according to claim 1, wherein the shock absorbing member is made of polyurethane resin.

3. A wristwatch comprising:

a wristwatch case having a side portion provided with an operation member;

a case back attached to a back surface of the wristwatch case;

a band attached to the side portion of the wristwatch case;

a shock absorbing member that is made of a flexible resin and includes a peripheral side portion surrounding the wristwatch case which projects further outward than a top surface of the wristwatch case and a bottom portion to which the case back is attached, and the peripheral side portion is provided with a band hole where the band is inserted and an operation hole corresponding to the operation member, wherein the band hole and the operation hole are respectively formed from an area under a top end surface of the peripheral side portion of the shock absorbing member to the bottom portion, and wherein the bottom portion of the shock absorbing member is provided with a case back fixing portion having an engaging projection portion that is interposed between the wristwatch case and the case back, and the case back is fixed to the bottom portion of the shock absorbing member, along with the wristwatch case by the engaging projection portion of the case back fixing portion.

4. The wristwatch according to claim 3, wherein the shock absorbing member is made of polyurethane resin.

* * * * *